US006209878B1

(12) United States Patent
Munro

(10) Patent No.: US 6,209,878 B1
(45) Date of Patent: Apr. 3, 2001

(54) PORTABLE SOCCER GOAL

(76) Inventor: Alick R. Munro, 1330 Celese Cir., Reno, NV (US) 89511-9416

( * ) Notice: Subject to any disclaimer, the term of this patent is extended or adjusted under 35 U.S.C. 154(b) by 0 days.

(21) Appl. No.: 09/283,875

(22) Filed: Mar. 31, 1999

Related U.S. Application Data

(60) Provisional application No. 60/080,199, filed on Mar. 31, 1998.

(51) Int. Cl.[7] ..... A63B 63/00
(52) U.S. Cl. ..... 273/400; 473/478
(58) Field of Search ..... 273/398, 900, 273/402; 473/478

(56) References Cited

U.S. PATENT DOCUMENTS

| | | | | |
|---|---|---|---|---|
| 4,420,158 | * | 12/1983 | Klock et al. | 473/478 |
| 4,702,478 | | 10/1987 | Kruse . | |
| 5,273,292 | | 12/1993 | Pardi et al. . | |
| 5,308,082 | | 5/1994 | Bigelow . | |
| 5,308,083 | | 5/1994 | Grunfeld et al. . | |
| 5,333,880 | | 8/1994 | Allbright . | |
| 5,346,227 | | 9/1994 | Amram et al. . | |
| 5,372,368 | | 12/1994 | Pavonetti . | |
| 5,421,586 | | 6/1995 | Amram et al. . | |
| 5,476,266 | | 12/1995 | Caruso . | |
| 5,842,939 | | 12/1998 | Pui et al. . | |
| 5,954,600 | * | 9/1999 | Gill | 473/478 |

FOREIGN PATENT DOCUMENTS

| | | | | |
|---|---|---|---|---|
| 2636659 | * | 3/1990 | (FR) | 473/FOR 212 |

* cited by examiner

*Primary Examiner*—Mark S. Graham
(74) *Attorney, Agent, or Firm*—Kenehan & Lambertsen, Ltd.; John C. Lambertsen

(57) ABSTRACT

A collapsible, portable sporting goal frame is provided, having a pair of side support frames connected by a pair of flexible cables. Each of the side frames is constructed of a sequence of individual tubular frame members that connect to one another on an end-to-end basis. An elastic cord runs through each of the tubular members, and is placed in a stretched configuration when the tubular members are slidably connected together, end-to-end. The elastic cord thereby applies a compressive force against the connected frame members, resisting the unintentional disassembly thereof. When storage or transport is required, the individual members slide apart, with the elastic cord maintaining sequential order of the frame members. The net is attached to the flexible cables and the tubular frame members collapse in a manner forming a take-up spindle for the netting.

17 Claims, 2 Drawing Sheets

PORTABLE SOCCER GOAL

CROSS-REFERENCE TO RELATED APPLICATION

This application claims the benefit of U.S. Provisional Application, Serial No. 60/080,199, filed Mar. 31, 1998.

BACKGROUND OF THE INVENTION

1. Field of the Invention

The present invention relates to portable framework structures and, more particularly, to such structures as are used with a net to construct a goal for use in various sporting events. More specifically, the present invention relates to a portable soccer goal that is constructed of interconnecting components that can be easily assembled and disassembled.

2. Description of the Prior Art

Although soccer has long been the world's most popular sport, in the United States soccer was virtually ignored throughout the 1960's and 1970's. However, beginning with youth programs in the 1980's, the popularity of soccer has dramatically increased, achieving nation-wide recognition in 1994 when the World Cup events were held in the United States.

Baseball remains the "national past time"; however, soccer is in rapid pursuit. In the year just prior to the World Cup competition, 12 million youngsters under age 18 had placed soccer even in popularity with softball and touch football. Moreover, according to the Soccer Industry Council of America, soccer's popularity cuts across demographic and geographic lines. Females account for over half of the players, and California and New York, followed by Texas, Pennsylvania, and Ohio, have the greatest percentage of children participating in the sport. Children of ages from 7–11 years represent the single largest number of soccer players, accounting for approximately 42% of the nation's players. The "youth" of soccer is readily apparent, with players of age from 7–7 representing over 70% of the nation's soccer players.

This rising popularity of soccer has resulted in the establishment of increasing numbers of recreational and competitive soccer teams. With the sport being taken more seriously, "semi-professional" coaches have been hired and practice regimens are scheduled. Fortunately, the required equipment for practicing is minimal in comparison with some other sports, with a soccer ball and a rectangular field area all that is required.

To increase the benefits of practice, simulation of the "goal area" is desired. In order to sharpen both goal-tending skills and goal-scoring ability, it is important that all three dimensions, height, width, and depth of an official goal be present and available during at least part of the practice sessions.

Since schools are in large part responsible for the awakening of children's interest in soccer, school grounds are frequently the sight of soccer practicing. Unfortunately, the majority of schools are unable to provide great numbers of "permanent" soccer fields, and thus most soccer teams and players must rely upon portable soccer goals if such enhanced practice sessions are to be provided on a regular basis.

Regulation soccer goals measure 24 feet by 8 feet, and replication of such a large netted structure in a portable design has proven to be somewhat difficult. One solution has been to utilize basically the same components as in a permanent soccer goal, with attachment to a wheeled foundation provided in the place of ground-foundation structures. The resulting goal is quite heavy, and presents safety concerns to those around it, as will be discussed hereinafter.

An alternative solution has been the construction of soccer nets on site using a multiple-component framework to which separate netting is attached. Once assembled, the framework design tended to simulate the more permanent soccer net structures, and consequently included a number of heavy, over-sized components that were of marginal portability. Additionally, by separating the netting from the outer framework, the opportunities for inadvertent separation of the two components increased.

In addition to being of questionable portability, the semi-permanent wheeled nets and the use of heavy, multi-component frames also present a safety risk. When improperly installed or when they are used in a manner for which they were not designed. Such non-soccer activities have included being climbed upon or used to perform acrobatics, with severe, if not fatal injuries, a result. In one case, as one person climbed on the horizontal header of a 600-pound steel goal post, the goal post tipped forward and struck the head of another person who was hanging from the header, resulting in fatal injuries. At the time of the incident, this goal post was not properly anchored to the ground. In another case, while lifting a corner of the goal post to remove a net for storage, the goal post fell, striking the head of a three-year-old boy—again resulting in fatal injuries.

Over a fourteen-year period, the Consumer Products Safety Commission investigated 27 injuries relating to falling soccer goal posts. Eighteen of these injuries were fatal, primarily as a result of head trauma, with the injured being predominantly male, and ten-year old (average age). Of the 27 goal posts involved, 26 were made of metal, usually steel or galvanized pipe and 23 of the goal posts were mobile. Virtually all of the injuries occurred when the goal post fell forward, its top cross bar striking the victim.

All 27 events were witnessed, and in the majority of cases an adult was either directly supervising or in the general vicinity at the time of the injury. With the mouth of a soccer goal post completely open to the playing field, only three sides of the goal are available to stabilize and prevent a forward collapse of the goal. The injuries typically resulted from climbing on the goal posts, swinging or hanging from cross bars, or from doing chin-ups on the crossbars. The Consumer Products Safety Commission recommends that goal posts not in use should be either chained to a fence or other permanent structure, placed goal-faced-down on the ground, or disassembled for storage.

The growing popularity of soccer has resulted in an increased need for portable soccer goals. Portability and safety concerns both require that such goals be lightweight, with easy assembly and disassembly by their users. Additionally, since many times such practice sessions occur with few adults present, it is important that when disassembled, the soccer net be as compact and easy to carry as possible.

SUMMARY OF THE INVENTION

It is an object of the present invention to provide a sporting goal that can be easily set up and dismantled, and that can be reduced in size for ease in portability.

It is a further object of the present invention to greatly eliminate or minimize the need for clips and fasteners to attach the netting to a support framework.

A still further object of the present invention is to construct the frame out of multiple members of minimum individual length, permitting collapse of the frame to a minimum size while the assembled size of the frame enables the use of a larger net.

A still further object of the present invention is to utilized the collapsed, individual frame members of minimum length to provide a spindle about which the netting may be wound for further ease in transporting the collapsed net.

A further object of the present invention is to attach the support frames to one another in a manner that does not require a rigid frame member, yet also provides a support from which the netting can be hung.

A further object of the present invention utilizes a non-rigid connecting member to attach the pair of support frames to one-another in a manner that easily defines and establishes the overall dimensions of the goal when fully erected, as well as further assists in conforming the collapsed framework to a shape about which the netting can be easily wrapped.

In this regard, a portable soccer goal utilizes a net spread between and supported by a pair of side support frames. Each frame is constructed of multiple individual tubular sections that may be joined together in an end-to-end manner. An elastic cord runs within the tubular sections, and the compressive force occasioned by the stretching of this cord when adjacent frame sections are joined assists in maintaining the structural rigidity of the assembled frame construction.

A flexible cable connects the two frame members together, and is used to suspend the netting that will extend between the two frames when fully deployed. The netting remains attached to the cables during storage, which insures a degree of order that assists in both the set-up and teardown operations. Additional lateral support is provided the erected goal by tensioning straps that are attached to each support frame and extend away from the net to a stake that is temporarily anchored in the ground.

Disassembly of the frame requires only a temporary, further stretching of the cord to separate the end-to-end frame member attachment. The elastic cord then permits the adjoining frame members to fold together to create the spindle-like structure used to receive the attached netting.

Some further objects and advantages of the present invention shall become apparent from the ensuing description and as illustrated in the accompanying drawings.

DETAILED DESCRIPTION OF THE PREFERRED EMBODIMENTS

Figure 1:
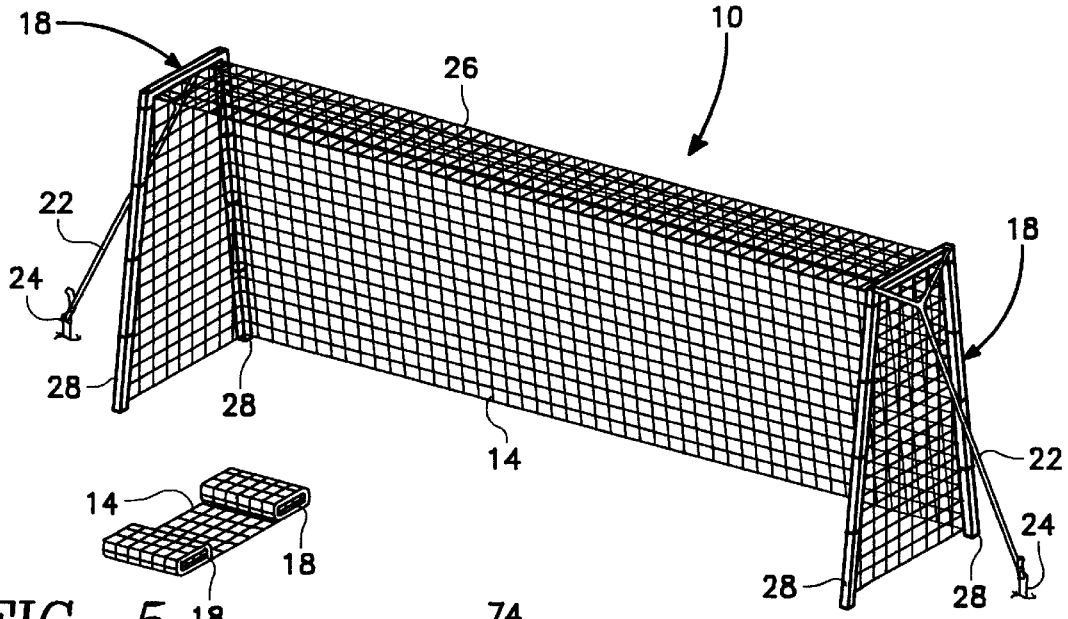
FIG. 1 is a perspective view, with portions broken away, showing a portable soccer net in accordance with the present invention.

Reference is now made to the drawings wherein like numerals refer to like parts throughout. A portable soccer goal 10 is shown in FIG. 1, having a net 14 spread between and supported by a pair of side support frames 18. Additional support for the soccer goal 10 is provided by a pair of tensioning straps 22 that are attached to and extend from the side support frames 18 to an anchoring stake 24.

Figure 2:
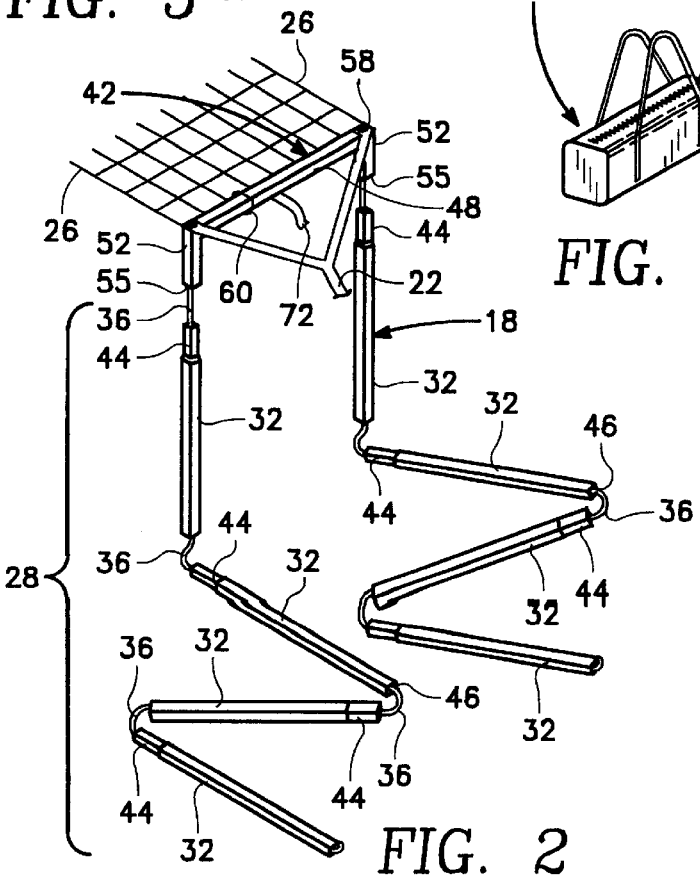
FIG. 2 is a partial perspective view showing a disassembled support framework in accordance with the present invention.

The pair of support frames 18 are attached to one another by a pair of lateral support cables 26 (best shown in FIG. 2) and by the net 14. In an embodiment as shown in FIGS. 1 and 2, the net 14 is attached to both side support frames 18 as well as being slidably received upon the lateral support cables 26 (FIG. 2). In this manner, when the side support frames 18 are spaced apart to the maximum extent permitted by the support cables 26, the support frames 18 and the support cables 26 form a supporting frame of proper dimensions over which the net 14 extends.

When fully erected, the side support frames 18 include a pair of support legs 28. Turning to FIG. 2, each of the support legs 28 consist of a plurality of individual leg segments 32. In the case of each of the support legs 28, the individual leg segments 32 are interlinked by an elastic cord 36. Extending from a head beam 42 of the side support frame 18 to the most distant leg segment 32, the elastic cord 36 has a length shorter than the fully extended support leg 28. As a result, the elastic cord 36 exerts a compressive force against each of the individual leg segments 32 when the support leg 28 has been fully assembled.

The interconnections between the adjacent leg segments 32 are formed in a manner to advantageously utilize the compressive force generated by the elastic cord 36. The individual leg segments 32 have an attachment sleeve 44 formed at a first end of each leg segment 32 with an end socket 46 formed at an opposite end of the leg segment 32. In this manner, with the individual leg segments 32 placed in an end-to-end arrangement, the attachment sleeves 44 of adjoining leg segments 32 are received within the end sockets 46 of the next-adjoining leg segment 32.

The head beam 42 includes a lateral cross brace 48 with a pair of bracket legs 52 formed at either end thereof. As shown in FIGS. 1 and 2, the various supporting structures are formed of a rectangular stock material, such as PVC tubing. In a presently preferred alternative embodiment, circular aluminum tubing is used instead to form the side support frames 18, including both the head beam 42 and the plurality of individual leg segments 32 that form the pair of support legs 28.

Figure 3:
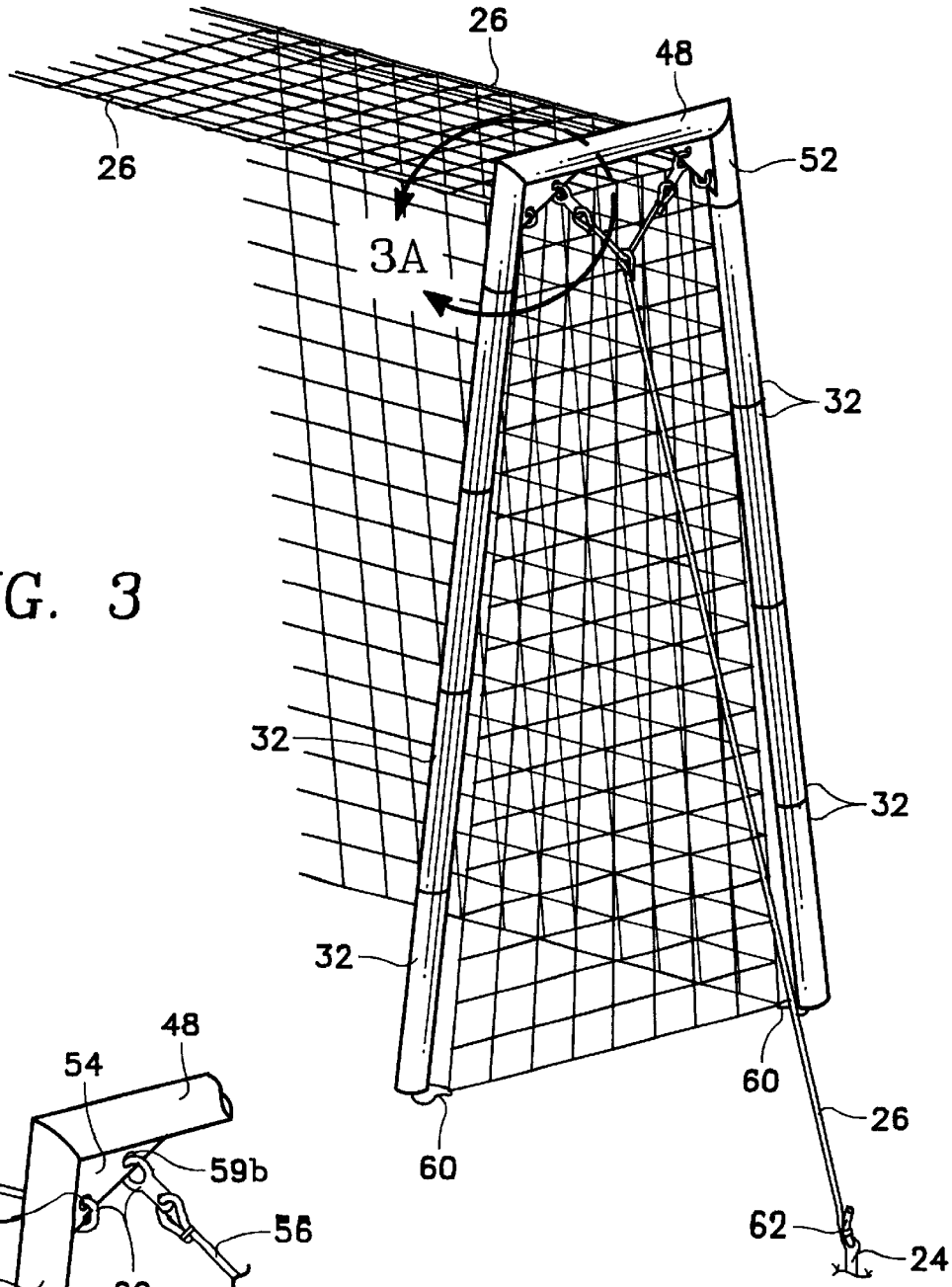
FIG. 3 is a partial perspective view showing a partially erected support framework and tie-down system in accordance with the present invention.

Such a preferred, alternative embodiment is shown in FIG. 3, where a pair of triangularly-shaped corner gussets 54 are provided, each attached to a separate one of the bracket legs 52 and extending to an adjacent portion of the lateral cross brace 48. This pair of corner gussets 54 are particularly advantageous when the frame structure is fabricated out of this extruded aluminum tubing, as they further enhance the structural integrity of the head beam 42. Additionally, as will be subsequently discussed, regardless of the fabrication material used to form the side support frames 18, the pair of corner gussets 54 also provide an improved and simplified attachment location for the net 14.

Returning momentarily to FIG. 2, the bracket legs 52 each have a sleeve-receiving opening 55 formed therein of a size to receive the attachment sleeve 44 of an initial one of the plurality of leg segments 32. In this manner each of the support legs 28 is received by the head beam 42, with the compressive force exerted by the extended elastic cord 36 biasing the individual leg segments 32 together at each of the attachment sleeve-end socket connections, as well as biasing the individual support legs 28 to the head beam 42.

Figure 4:
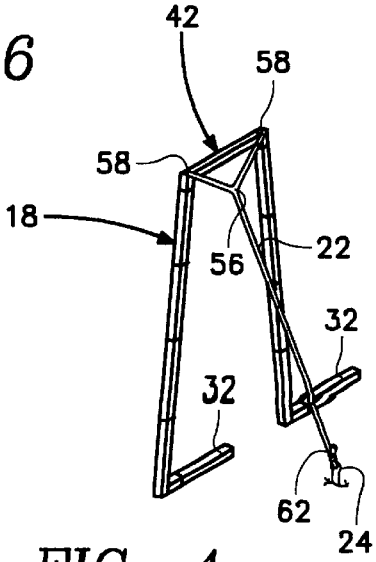
FIG. 4 is a partial side elevation view showing a side support framework having an alternative, enhanced support bracing system in accordance with the present invention.

Such a configuration is clearly shown in FIG. 4, with only the final leg segments 32 requiring insertion to complete the formation of the support legs 28. FIG. 4 also illustrates one mechanism by which the tensioning straps 22 provide additional stability for the side support frames 18.

In addition to providing lateral stability, the tensioning strap 22 terminates in a Y-attachment strap 56 that puts equal pressure on both of the lateral support cables 26 (not shown in FIG. 4). The equalization of support obtained through the use of the Y-attachment strap 56 assists in providing fore-aft as well as torsional stability for the soccer goal 10 in a manner that would be extremely difficult to accomplish if separate support straps were provided on each side.

Figure 3A:
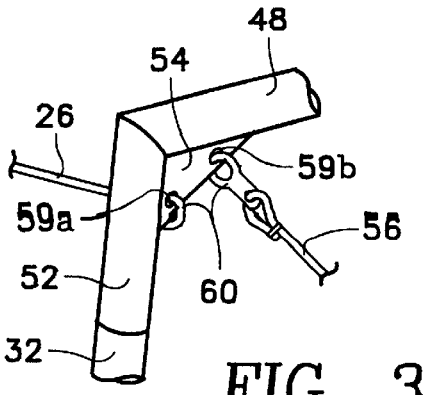
FIG. 3A is an enlarged perspective view taken within circle 3A of FIG. 3 showing the manner in which a net support cable and a tensioning strap are attached to a support brace in accordance with the present invention.

In FIG. 4, each leg of the Y-attachment strap 56 is attached to a separate one of the bracket legs 52 of the head beam 42 utilizing a strap fastener 58. A presently preferred alternative manner of attaching the Y-attachment strap 56 makes use of the pair of corner gussets 54 previously mentioned in the context of FIG. 3. As is best shown in FIG. 3A, a pair of inner and outer sleeve receiving openings 55*a*, 55*b* are formed in each of the corner gussets 54. A snaplink fastener 60 (also known as a carabiner) is attached to each terminal end of the Y-attachment strap 56, and then each is selectively attached to a separate one of the inner sleeve receiving opening 55*b* on the pair of corner gussets 54.

In a similar manner, the front and back lateral support cables 26 are preferably attached to the pair of corner gussets 54. As is also partially depicted in FIG. 3A, a separate snaplink fastener 60 is attached to each of the front and back lateral support cables 26. Each cable snaplink fastener 60 is then selectively attached to a separate one of the outer sleeve receiving openings 55*a* on the pair of corner gussets 54. Utilizing each of the pair of corner gussets 54 as the points of attachment for the Y-attachment strap 56 and the support cables 26, eliminates the extra fabrication step of forming the strap fasteners 58.

Adjustments in the tension applied by the tensioning straps 22 is preferably easily effected by the utilization of a friction or cam-lock fastener 62 to connect the tensioning straps 22 to the anchoring stake 24. Such a device enables the easy adjustment of the tension being applied by the tensioning straps 22, requiring only the prompt shortening or lengthening thereof.

The alternative methods of attaching the net 14 to the side support frames 18 are best explained by reference to FIGS. 2 and 3. In both cases, the lateral support cables 26 are each woven through and in the section of netting that separates the opposed pair of side support frames 18. Such interweaving within a cable of fixed length enables the netting to extend at a known, appropriate dimension when the portable soccer goal 10 is fully assembled. Such interweaving also assists in maintaining the net 14 in a favorable orientation during disassembly, as will be discussed hereinafter.

In the embodiment shown in FIG. 2, a further securement of the net to an upper portion of the support frame 18 is provided by utilizing one or more snaplinks or carabiners 60 to attach the net 14 to the cross brace 48 of the head beam 42. The presently preferred embodiment utilizing the corner gussets 54 as the attachment location for the support cables 26 does not require such additional snaplink attachment to the side support frames 18.

Turning now to FIG. 3, in the case of both embodiments, stabilization of the lower portion of the net 14 is preferably achieved by the use of additional snaplinks 60. A first snaplink attaches a lower front portion of the netting to a bottom opening of the front lower leg segment 32, and a second snaplink attaches a suitably spaced lower portion of the net to a bottom opening of the rear lower leg segment 32. To prevent snarls in the net during storage, both snaplinks should be attached to the lateral support cables 26. Since some users may not take this additional step, a presently preferred alternative attachment device is a bungee toggle fastener, consisting of a length of an elastic cord with the two ends fastened together within a small ball (not shown in the drawings).

The doubled cord is then threaded within a net opening, wrapped around one of the support frames, and when received over the ball attached to the other end of the cord, is secured in place. Since fabricated of an elastic member, the bungee toggle can also be used to apply a tension to the netting, resulting in an improved "bounce-back" of the soccer balls after impacting the net.

Whether by snaplinks or by bungee toggles, the netting 14 is releaseably secured to each of the support legs 28 during use of the portable soccer goal 10. However, the netting 14 is secured in a manner such that it can be easily removed therefrom during the disassembly of the support frame construction.

Figure 5:
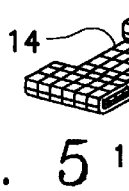
FIG. 5 is a perspective view showing the supporting framework for the portable tent disassembled and enwrapped in the netting material, forming a compact arrangement for storage in accordance with the present invention.

For ease in transport and assembly, as is shown in FIG. 5, each of the leg segments 32 are preferably fabricated out of a hollow tubing member. Although illustrated in FIG. 5 as if fabricated out of rectangular tubing, other geometric shapes are also appropriate, including the presently preferred use of circular tubing. When such circular tubing is used, the overall shape of the collapsed net and net supports is more circular than the rectangular shape depicted in FIG. 5.

The present inventive use of individually-segmented side support frames not only assists in the assembly of the portable soccer goal 10, but is also greatly advantageous during the disassembly, transportation, and storage of this portable soccer goal 10. Disassembly is preferably initiated by releasing the netting from its attachment to each of the side support frames 18, detaching the snaplinks 60 that attach the lower edge of the netting to the lower openings of each of the support legs 28. Thereafter, tension is released from the tensioning straps 22, permitting the lowering of the side support frames 18.

The tensioning straps 22 are then either disconnected from the anchoring stake 24 or the stakes are removed from the ground. Each of the support legs 28 may then be collapsed by the sequential removal of the adjoining leg segments from one another. Linked together by the elastic cord 36, adjacent leg segments 32 conveniently fold against one another in a serpentine manner. Each of the support legs 28 collapses to form a substantially compact, rectangularly-shaped cube if plastic segments are used, or a tubular-shape if circular aluminum segments form the support legs 28.

The head beam 42 is preferably dimensioned such that it generally corresponds in length to each of the collapsed support legs, permitting both collapsed legs and the head beam 42 to collectively form a compact structure that can be held together utilizing a storage strap 72 (see FIG. 2) of sufficient length to encircle the two collapsed support legs and retain them in position adjacent the head beam 42.

Figure 6:
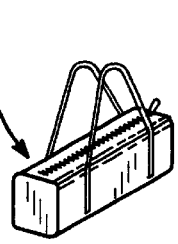
FIG. 6 is a perspective view showing a storage and transport container for the portable net in accordance with the present invention.

Turning now to FIG. 5, with the side support frames 18 neatly collapsed and secured, such collapsed frames can conveniently function as a spool about which to wrap the netting 14. With the collapsed support frames 18 located at each end of the netting 14, each of the collapsed support frames need only take up one-half of the netting 14. The resulting collapsed structure is of greatly compacted dimensions in comparison to the erected portable soccer goal 10, and can be conveniently stored and transported in a carrying case 74 (see FIG. 6).

In a preferred embodiment, the individual leg segments 32 of the support legs 28 are fabricated out of swaged or sleeved circular metal tubing, 1 in diameter, such as aluminum, or out of a circular plastic, PVC tubing. To achieve a goal area of four (4) feet deep, the rear support leg must be angled away from the front support leg, forming an angle of approximately 101° versus 90° for the front. Additionally, one of the leg segments used in each of the rear support legs must be slightly longer than those segments used in the front legs.

In a preferred embodiment, the longer section measures 28¼ in length, with all of the remaining leg segments, for both the front and rear support legs, measuring 26½ in length. For each of the leg segments, that portion of the segment that is swaged to form the attachment sleeve 44 has a reduced dimensions of ⅞ in diameter and extends a length of 3" from the non-reduced portion of the leg segments. While a greater length of sleeve would provide a support leg having greater structural rigidity, it would also make assembly and disassembly of the support legs more difficult. Conversely, while a shorter sleeve would somewhat simplify construction, the ability of the resulting support leg to bear any side loading would be significantly reduced.

The elastic cord 36 is preferably a cord of length 6 feet and an un-stretched diameter of 4 mm, constructed of FiberTex. It is preferably attached to the bracket leg 52 and the lower leg segment 32 by a pin or a screw. The tensioning straps are semi-elastic, functioning as shock absorbers to protect the integrity of the light frames when they are struck, and are fabricated out of nylon or polyester of width 1 and thickness of approximately 1/11". The anchoring stake 24 can be fabricated out of a variety of materials, with 6" to 12" being preferred in areas of harder ground. The tensioning strap 22 is preferably attached to the anchoring stake 24 using an adjustable fastener, such as Cambuckle #Y1823, manufactured by Bungee International of Oxnard, Calif.

Traditional netting used for soccer has a rectangular mesh size of approximately 6" (diagonal), and is constructed out of polyester material of thread size approximately 1–3 mm in diameter, with 2 mm preferred.

My invention has been disclosed in terms of a preferred embodiment thereof, which provides an improved soccer goal that is of great novelty and utility. Various changes, modifications, and alterations in the teachings of the present invention may be contemplated by those skilled in the art without departing from the intended spirit and scope thereof. It is intended that the present invention encompass such changes and modifications.

I claim:

1. A sports goal having a net and a frame, said frame comprising:

a pair of side support frames, each of said pair further comprising:

a plurality of tubular frame members, each having an attachment sleeve formed at a first end and an end socket formed at a second end, said attachment sleeve of a reduced circumference and adapted to be received by and mate with said end socket of an adjoining one of said plurality of tubular frame members when placed substantially in registration with one another, a head beam having at least two end sockets formed therein and detachably receiving a pair of said tubular frame members said head beam generally corresponding in length to each of said tubular frame members, and an elastic cord received within each of said tubular frame members and said head beam, and flexibly interconnecting same, said elastic cord maintaining connection between adjacent mating tubular frame members and between said head beam and adjacent mating tubular frame members when said side support frame is in a collapsed state said head beam and said collapsed state side support members collectively forming a spool to receive said net for transport and storage; and at least one flexible support cable attached to and extending between said pair of side support frames.

2. A goal frame according to claim 1, wherein two flexible support cables are provided and are attached to said head beam on each of said pair of side support frames.

3. A goal frame according to claim 1, wherein a plurality of said tubular frame members of said pair of side support frames are sequentially arranged with alternating first and second ends of respective adjacent frame members.

4. A goal frame according to claim 3, wherein said plurality of sequentially arranged tubular frame members are arranged as a pair of separate sequentially arranged multiple frame members.

5. A goal frame according to claim 4, wherein said head beam is interspaced between and detachably receives and connects said pair of separate sequentially arranged multiple frame members.

6. A goal frame according to claim 5, wherein said flexible support cable is attached to said head beam of each side support frame.

7. A goal frame according to claim 6, wherein two flexible support cables are provided.

8. A goal frame according to claim 1, and further comprising a tensioning support strap attached to and extending from each of said pair of side support frames, a terminus of said tensioning support strap adapted for temporary attachment to a support.

9. A goal frame according to claim 8, wherein said tensioning support strap is attached to said head beam.

10. A goal frame according to claim 9, wherein said terminus is a ground stake.

11. A portable sporting goal comprising:

a framework comprising a pair of support frames, each of said support frames comprising:

a plurality of tubular frame members sequentially arranged and interconnecting with one another in a substantially linear manner, a tubular cross brace received by and interspersed between said sequential arrangement of interconnected tubular frame members, an elastic cord received by and extending within said tubular cross brace and said sequential arrangement of interconnected tubular frame members said elastic cord maintaining said sequential arrangement of said tubular frame members and said tubular cross brace when each is disconnected from an adjacent member of said framework to define a collapsed state, said tubular brace and said tubular frame members collectively defining a spool to receive said net for transport and storage when in said collapsed state, and a flexible cable attached to and extending between each of said pair of support frames; and a net attached to and adapted to drape from said flexible cable.

12. A portable goal according to claim 11, wherein said flexible cable is detachably attached to said tubular cross brace of each of said pair of support frames and wherein said flexible cable is received by said net in an interwoven manner with a plurality of individual mesh of said net.

13. A portable goal according to claim 12, and further comprising a pair of lateral support cables, each attached to a separate one of said pair of support frames and extending to form a detachable connection with a support surface.

14. A portable goal according to claim 11, wherein alternating ends of said sequentially arranged tubular frame members form attachment sleeves of reduced diameter adapted for slidable interengagement with adjacent tubular members when the adjacent pair of tubular members are substantially in registration with each other.

15. A portable goal according to claim 11, wherein said tubular cross brace is received within said sequential arrangement of tubular frame members in a manner defining a first support leg and a second support leg, each comprising a plurality of tubular frame members.

16. A portable goal according to claim 15, and further comprising a plurality of connectors releasably attached to said net and separate ones of said pair of support legs of said tubular frame members.

17. A portable goal according to claim 16, wherein said plurality of connectors comprise friction fasteners.

* * * * *